US006070432A

United States Patent [19]

Lavin

[11] Patent Number: 6,070,432

[45] Date of Patent: Jun. 6, 2000

[54] PRODUCTION OF CRYOGENIC LIQUID MIXTURES

[75] Inventor: John Terence Lavin, Guildford, United Kingdom

[73] Assignee: The BOC Group plc, Windlesham, United Kingdom

[21] Appl. No.: 09/010,972

[22] Filed: Jan. 22, 1998

[30] Foreign Application Priority Data

Jan. 31, 1997 [GB] United Kingdom ..... 9702074

[51] Int. Cl.[7] ..... F25J 3/00

[52] U.S. Cl. ..... 62/640; 62/643

[58] Field of Search ..... 62/615, 640, 643, 62/652, 901

[56] References Cited

U.S. PATENT DOCUMENTS 4,526,595 7/1985 McNeil .
4,566,887 1/1986 Openshaw ..... 62/652
5,656,557 8/1997 Hata et al. ..... 62/615 X
5,697,228 12/1997 Paige ..... 62/615

*Primary Examiner*—William Doerrler
*Attorney, Agent, or Firm*—David M. Rosenblum; Salvatore P. Pace

[57] ABSTRACT

A product cryogenic liquid mixture comprising oxygen and nitrogen having a chosen mole fraction of oxygen is produced by expanding, typically through a valve, a pressurized stream of a precursor fluid mixture, which may be liquid air, having a mole fraction of oxygen greater than said chosen mole fraction, and thereby forming a vapor phase depleted of oxygen and a liquid phase enriched in oxygen. The vapor phase is disengaged from the liquid phase in a phase separator. A stream of the vapor phase is condensed in a condenser. The condensate is collected in a storage vessel as the product cryogenic liquid mixture.

16 Claims, 3 Drawing Sheets

PRODUCTION OF CRYOGENIC LIQUID MIXTURES

BACKGROUND OF THE INVENTION

This invention relates to a method of and apparatus for producing a product cryogenic liquid mixture comprising oxygen and nitrogen having a chosen mole fraction of oxygen.

EP-A-0 657 107 discloses that a combined mixture of liquid oxygen and a liquid nitrogen having a chosen mole fraction of oxygen less than the mole fraction of oxygen in natural air is particularly useful in providing, on evaporation, a breathable refrigerating atmosphere. Producing such a liquid cryogen therefore requires the separation of oxygen and nitrogen from air, typically in one or more cryogenic rectification columns, followed by the remixing of the two gases. A considerable amount of work needs to be expended in order to separate the air. Only a relatively small proportion of this work can be recovered when the two gases are remixed.

The present invention relates to an improved method and apparatus for producing a product cryogenic liquid mixture comprising oxygen and nitrogen having a chosen mole fraction of oxygen.

SUMMARY OF THE INVENTION

According to the present invention there is provided a method of producing a product cryogenic liquid mixture comprising oxygen and nitrogen having a chosen mole fraction of oxygen, comprising expanding a pressurized stream of a precursor fluid mixture comprising oxygen and nitrogen having a mole fraction of oxygen greater than said chosen mole fraction so as to form a primary two-phase mixture comprising a vapor phase depleted of oxygen and a liquid phase enriched in oxygen, disengaging the vapor phase from the liquid phase, condensing a stream of the vapor phase, and passing the condensate to storage as said product cryogenic liquid mixture.

The invention also provides apparatus for producing a product cryogenic liquid mixture comprising oxygen and nitrogen having a chosen mole fraction of oxygen, comprising means for expanding a pressurized stream of a precursor cryogenic fluid mixture comprising oxygen and nitrogen having a mole fraction of oxygen greater than said chosen mole fraction so as to form a primary two-phase mixture comprising a vapor phase depleted of oxygen and a liquid phase enriched in oxygen, means for disengaging the vapor phase from the liquid phase, a condenser for condensing a stream of the vapor phase, and a storage vessel for storing the condensate as said product cryogenic liquid mixture.

The method and apparatus according to the present invention thereby avoid the need to mix oxygen and nitrogen which have been separated by distillation or rectification at a cryogenic temperature.

The stream of the vapor phase is preferably condensed in heat exchange with a stream of the liquid phase, the stream of the liquid phase having been expanded upstream of its heat exchange with the stream of the condensing vapor phase.

The stream of precursor cryogenic fluid mixture is preferably formed by separating water vapor and carbon dioxide from, and cooling, the flow of compressed air. The flow of compressed air is preferably cooled in heat exchange with at least one stream of working fluid which has been expanded, typically in an expansion turbine, with the performance of external work, or in heat exchange with one or more return streams from rectification column in which air is separated. In addition, the flow of compressed air may be cooled in heat exchange with the stream of the liquid phase disengaged from the primary two phase mixture, the said stream of the liquid phase entering this heat exchange downstream of its heat exchange with the vapor phase of the primary two-phase mixture. If desired, the flow of the compressed air can be cooled in a heat exchanger forming part of an apparatus in which air is separated by distillation or rectification at cryogenic temperatures. Accordingly, the apparatus according to the invention can share the air purification and air cooling means with the air separation apparatus.

The apparatus according to the invention preferably additionally includes an air liquefier for forming the pressurized stream of the precursor cryogenic fluid mixture, or a stream from which the pressurized stream of the precursor cryogenic fluid mixture is able to be derived. The air liquefier may form part of an air separation apparatus.

The product cryogenic liquid mixture according to the invention preferably has a mole fraction of oxygen in the range of from between about 0.14 to about 0.20, more preferably about 0.15 to about 0.18.

The pressure of the stream of the precursor cryogenic fluid mixture and the pressure to which it is expanded to form the primary two-phase mixture may therefore be selected so as to give the chosen mole fraction of oxygen in the vapor phase. Although it is generally preferred to use a flow of cooled, compressed air as the precursor cryogenic fluid mixture, an alternative, which is useful particularly if the mole fraction of oxygen in the product cryogenic liquid mixture is in the lower part of the above-mentioned range, comprises forming the stream of precursor fluid mixture by separating water vapor and carbon dioxide from, and cooling, a flow of compressed air, expanding the compressed air so as to form a secondary two-phase mixture comprising a vapor phase depleted of oxygen and a liquid phase enriched in oxygen, disengaging the vapor phase of the secondary two-phase mixture from the liquid phase of the secondary two-phase mixture, and condensing the vapor phase of the secondary two-phase mixture. Also in such examples, the vapor phase of the secondary two-phase mixture is preferably condensed in indirect heat exchange with a stream of the liquid phase of the secondary two-phase mixture, the stream of the liquid phase of the secondary two-phase mixture having been expanded upstream of its heat exchange with the stream of the condensing vapor phase of the secondary two-phase mixture. In such examples, the flow of compressed air may be cooled in the same manner as in those examples in which a stream of cooled air forms itself the precursor cryogenic fluid mixture.

Preferably the precursor cryogenic fluid mixture begins its expansion as a supercritical fluid. Alternatively, it may begins its expansion in liquid state.

The invention also provides the use of a product cryogenic liquid mixture produced by the method and apparatus according to the invention, in forming a breathable refrigerating atmosphere.

BRIEF DESCRIPTION OF THE DRAWINGS

The method and apparatus according to the invention will now be described by way of example with reference to the accompanying drawings, in which.

The drawings are not to scale.

DETAILED DESCRIPTION

Figure 1:
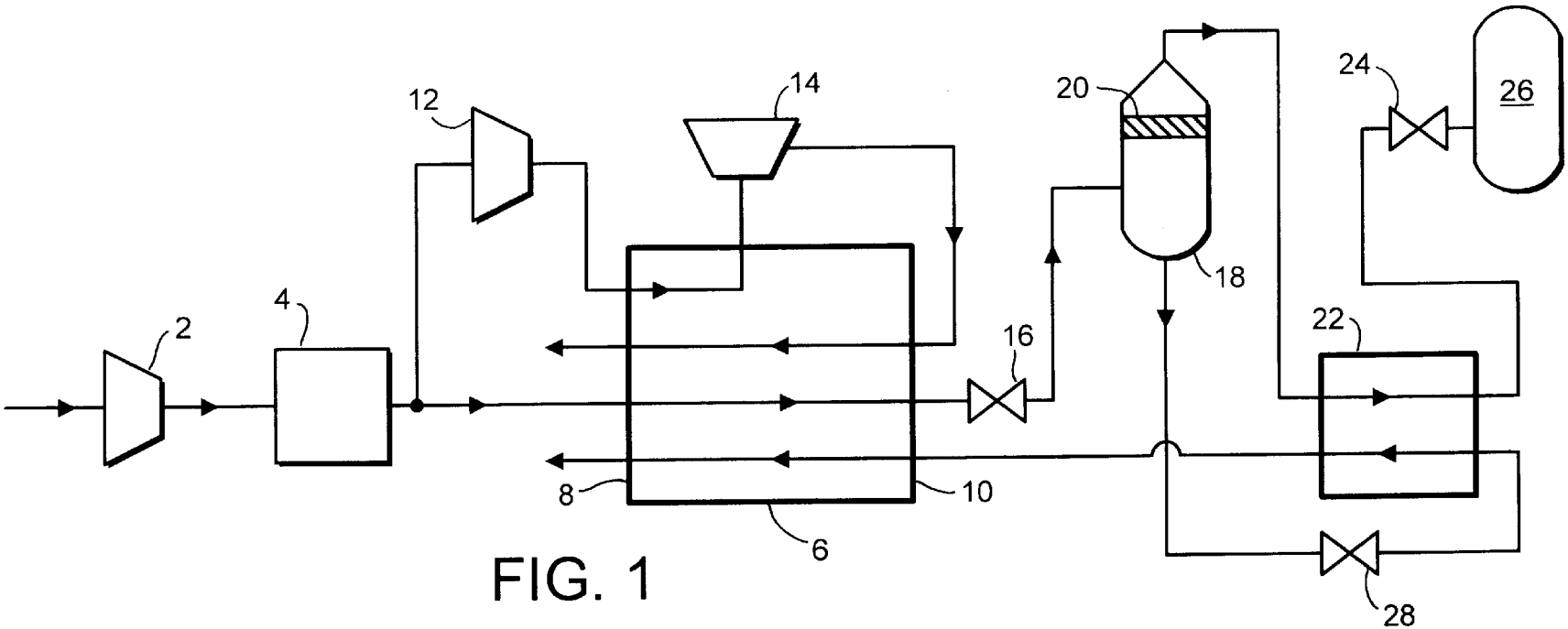
FIG. 1 is a schematic flow diagram of a first apparatus for producing a product cryogenic liquid.

Referring to FIG. 1 of the drawings, a stream of air is compressed in a plural stage compressor 2 to a chosen elevated pressure. Although not shown, the plural stage compressor 2 has downstream of each stage an aftercooler to remove the heat of compression from the air. The thus compressed air is purified in a pre-purification unit 4 by adsorption so as to remove water vapor, carbon dioxide and higher hydrocarbon impurities therefrom. The construction and operation of such a purification units 4 are well known in the art of separation and need not be described further herein. The purified, compressed flow of air is divided into two streams. One stream flows through a main heat exchanger 6 from its warm end 8 to its cold end 10. If this stream of air enters the main heat exchanger 6 at below its critical pressure, the heat exchanger 6 is arranged such that this stream condenses therein. If the air is supplied above its critical pressure to the heat exchanger 6, the heat exchanger 6 is arranged such that on expansion to a sub-critical pressure, a two phase mixture of a liquid and vapor is formed.

The other stream of compressed, purified air is further compressed in a booster compressor 12. Resulting heat of compression is removed therefrom in an aftercooler (not shown) and is passed a part of the way through the main heat exchanger 6 from its warm end 8. The thus cooled further compressed air stream is withdrawn from the heat exchanger 6 at a temperature intermediate that of its warm end 8 and that of its cold end 10 and is expanded with the performance of external work in an expansion turbine 14. The air leaves the expansion turbine 14 at a chosen pressure and at a temperature which is typically in the order of 2K less than the temperature at which the air stream that flows all the way through the main heat exchanger leaves its cold end 10. The expanded air stream then passes through the heat exchanger 6 from its cold end 10 to its warm end 8 and is returned to an appropriate stage of the plural stage compressor 2. The expansion turbine 14 thus provides the necessary refrigeration for the air stream being cooled in the main heat exchanger 6. If desired, a second turbine (not shown) may be used to take a further compressed air stream at approximately ambient temperature and expanded to a temperature intermediate the warm end and cold end temperatures of the main heat exchanger 6. This stream is typically introduced into the main heat exchanger 6 at an appropriate intermediate region thereof and flows back through the heat exchanger 6 to its warm end 8. Downstream of the warm end 8 the air stream may be reunited with the air being compressed. In another alternative embodiment (not shown) one or more expansion turbines may be fed with a compressed working fluid other than air and may flow around a closed circuit extending through the main heat exchanger. In a yet further example (not shown), the expansion turbine or turbines may form part of an air separation apparatus and rather than returning cold air through the main heat exchanger may instead supply this air to one or more rectification columns of the air separation apparatus, the air being cooled by heat exchange with return streams from the rectification column or columns.

The air stream which passes from the warm end 8 to the cold end 10 of the main heat exchanger 6 passes through an expansion valve 16 (sometime alternatively referred to as a Joule-Thomson valve or a throttling valve). A two phase mixture of liquid and vapor leaves the expansion valve 16 at a selected pressure typically in the range of between about 5 and about 20 bar. The resulting two phase mixture passes into a phase separator 18 in which the vapor disengages from the liquid. In order to limit the carry-over of liquid in the vapor phase, an upper internal portion of the phase separator 18 is provided with a packing or other liquid-vapor disengagement device 20 which helps to complete the disengagement of the vapor from the liquid. Since air is primarily a mixture of oxygen and nitrogen (there is also typically in the order of 1% by volume of argon), the vapor which flashes from liquid passing through the valve 16 is enriched in nitrogen, the more volatile component and hence depleted of oxygen, the less volatile component. Therefore, by the same token, the liquid phase leaving the valve 16 is enriched in oxygen.

A stream of the oxygen-depleted vapor phase is withdrawn from the top of the phase separator 18 and flows through a condenser 22 in which it is condensed by heat exchange. The resultant condensate is passed via another expansion valve 24 into a conventional thermally-insulated storage vessel 26. If desired, the liquid may be sub-cooled upstream of its passage through the expansion valve 24. Condensation of the stream of vapor phase in the condenser 22 is effected by heat exchange with a stream of the liquid phase which is withdrawn from the bottom of the phase separator 18. Upstream of its passage through the condenser 22 this stream of the liquid phase flows through an expansion valve 28 which typically reduces its pressure to a selected pressure in the range of 1 between about 0.2 and about 1.5 bar. The stream of the liquid phase is partially or totally vaporized in the condenser 22. Downstream of the condenser 22 it passes through the main heat exchanger 6 from its cold end 10 to its warm end 8 and is vented from the process. The cooling provided by the expansion of the liquid phase through the expansion valve 28 creates a sufficient temperature difference to effect the condensation of the stream of vapor phase in the condenser 22. The pressure ratio across the expansion valve 16 is arranged so as to give a vapor phase of chosen oxygen mole fraction. This mole fraction is typically in the range of between about 0.14 and about 0.20. An advantage of having an atmosphere whose oxygen mole fraction is less than that of natural air is that if the liquid stored in the vessel 26 is employed to form a breathable refrigerating atmosphere, any gradual enrichment of the liquid as vapor is formed from it is less likely to create a safety hazard.

Figure 2:
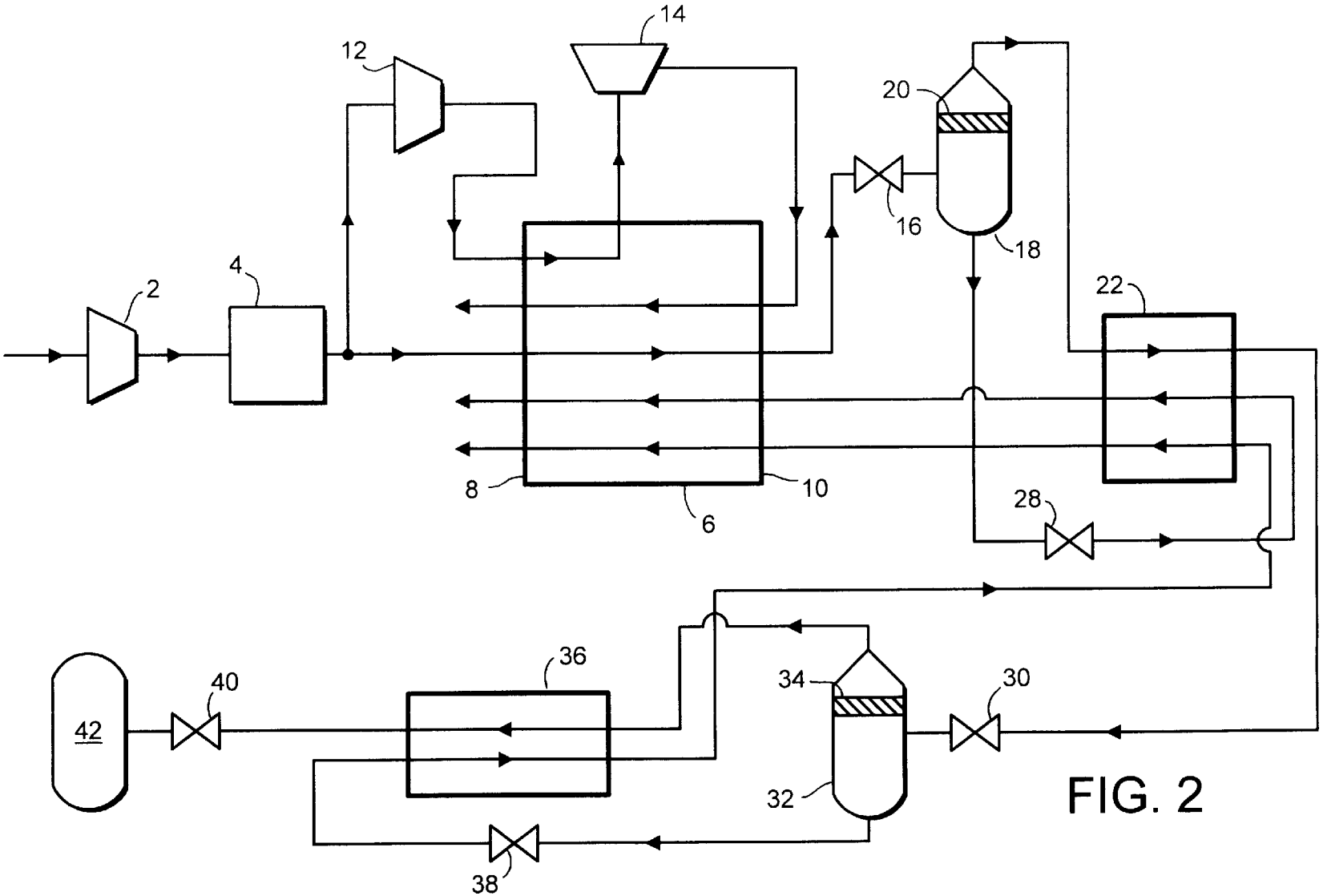
FIG. 2 is a schematic flow diagram of a second apparatus for producing a product cryogenic liquid.

Referring now to FIG. 2, the apparatus illustrated therein has similarities to that shown in FIG. 1 and like parts in the two FIGS. are indicated by the same reference numerals. The essential difference between the two apparatuses is that the condensate from the condenser 22 is not sent directly to storage. Instead, it is flashed through a second expansion valve 30 so as to form a secondary two-phase mixture comprising liquid and vapor. Thus, the vapor phase is further depleted of oxygen. The resulting liquid-vapor mixture passes into a second phase separator 32 having a packing 34 for assisting in the disengagement of vapor from liquid. A stream of the vapor phase is withdrawn from the top of the phase separator 32 and is condensed in a second condenser 36. The condensation in the second condenser is effected by heat exchange with a stream of liquid withdrawn from the bottom of the phase separator 32. Intermediate the phase separator 32 and the condenser 36 a stream of the liquid phase flows through another expansion valve 38. Downstream of its heat exchange with the condensing liquid, the stream of the liquid phase returns through the condenser 22 and the main heat exchanger 6.

The condensate from the condenser 36 flows through another expansion valve 40 to a storage vessel 42. If desired, the condensate may be sub-cooled upstream of its passage through the expansion valve 40. The apparatus shown in FIG. 2 is particularly useful if the composition of the liquid passed to the storage vessel 42 is required to have a relatively low oxygen mole fraction (say, in the order of 0.14).

Figure 3:
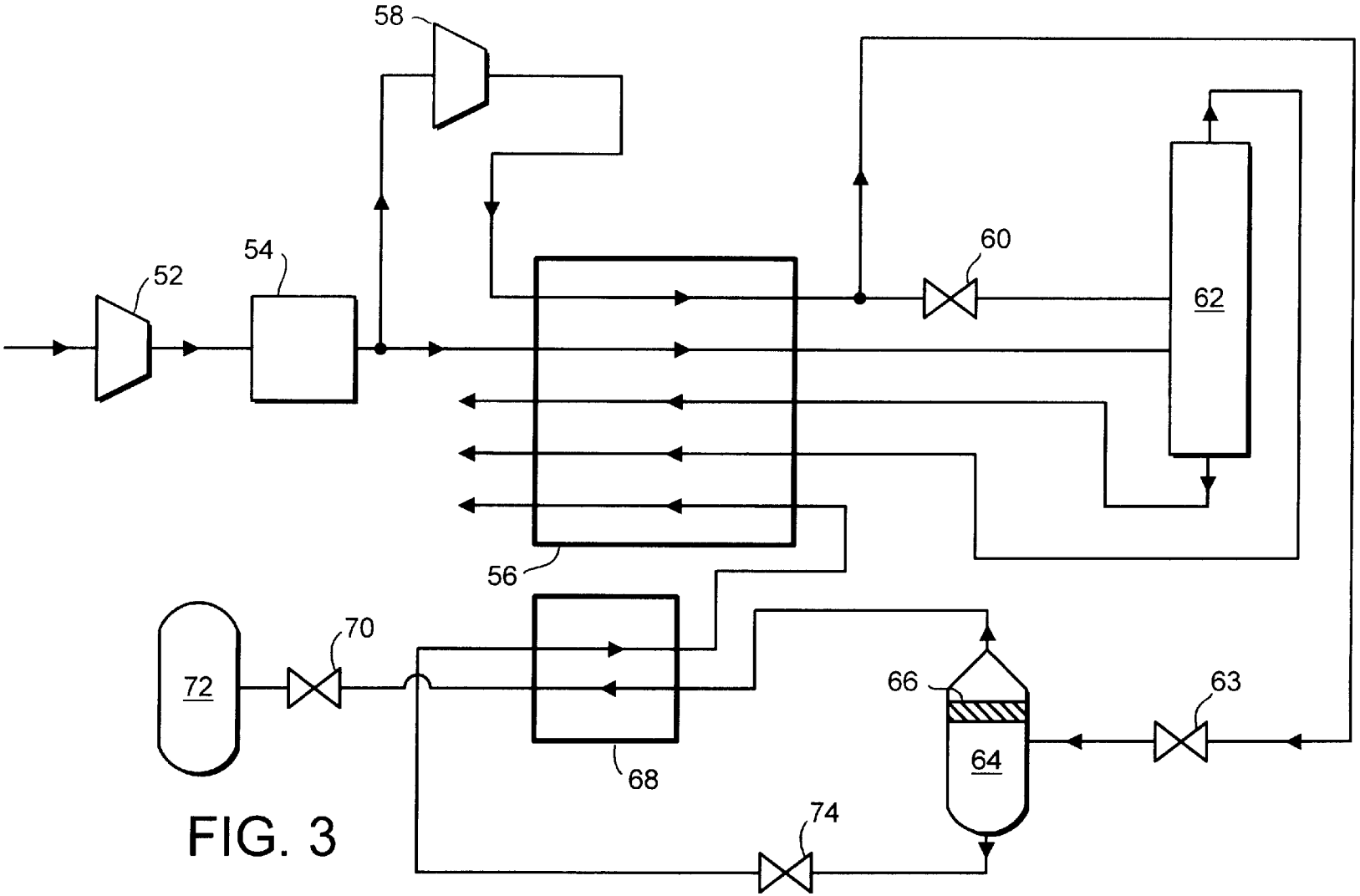
FIG. 3 is a schematic flow diagram illustrating the integration of an apparatus of the kind shown in FIG. 1 with a cryogenic air separation plant.

Referring now to FIG. 3, there is illustrated schematically an air separation plant comprising a main, plural stage compressor 52, a pre-purification unit 54 and a booster compressor 58 (which if desired may have more than one stage) and a main heat exchanger 56. All the incoming air is compressed in the compressor 52 and purified in the pre-purification unit 54. A part of the air flows through the main heat exchanger 56 and is cooled to a temperature suitable for its separation by rectification. If desired, this flow of air may be supplemented by one or more flows of air that have passed through one or more expansion turbines (not shown). The rest of the air passes through the booster compressor 58 and is cooled in the heat exchanger 56. This stream of air flows from the heat exchanger 56 through an expansion valve 60 and is thereby at least partially liquefied. The two streams of air flow to an arrangement of rectification columns, of a kind well known in the art, indicated generally by the reference numeral 62. There, the air is separated into oxygen-rich and nitrogen-rich fractions. One or more streams of the oxygen fraction and one or more streams of nitrogen fraction return through the heat exchanger 56 in countercurrent heat exchange with the air being cooled. A stream of air is taken from downstream of the cold end of the heat exchanger 56 and upstream of the expansion valve 60 and is passed through an expansion valve 63. A two-phase mixture comprising an oxygen-depleted vapor phase and an oxygen-enriched liquid phase issues from the expansion valve 63. The vapor phase is disengaged from the liquid phase in a phase separator 64 having a packing 66 adapted to facilitate disengagement of liquid from the vapor. A stream of the vapor phase is condensed in a condenser 68 and supplied via an expansion valve 70 to a storage vessel 72. A stream of the liquid phase from the phase separator 64 is passed through an expansion valve 74 and flows therefrom countercurrently to the stream being condensed through the condenser 68. The resulting stream exits the condenser 68 and passes countercurrently through the heat exchanger 56 from its cold end to its warm end. Alternatively, some or all of the resulting stream can be introduced into the lower pressure column of a double rectification column that is separating air. By appropriate design of the apparatus, sufficient high pressure air may be supplied from the booster compressor 58 in order to meet the demands of the rectification columns for liquid air (in order typically to provide liquid products) and to enable a desired quantity of cryogenic liquid mixture having a chosen mole fraction of oxygen in accordance with the invention.

In a typical example of operation of the apparatus shown in FIG. 1, the feed to the expansion valve 16 may be at a pressure of about 70 bar. The two phase mixture that exits the expansion valve 16 may be at a pressure of about 10.4 bar. The stream that is condensed in the condenser 22 has an oxygen mole fraction of about 0.15. The stream of the liquid phase from the phase separator 18 is expanded in the expansion valve 28 to a pressure of about 1.3 bar. This stream has an oxygen mole fraction of about 0.27. For each 10,000 $m^3$/hr of air that flows through the expansion valve 16, about 5,000 $m^3$/hr of cryogenic liquid having an oxygen mole fraction of about 0.15 is produced.

We claim:

1. A method of producing a product cryogenic liquid mixture comprising oxygen and nitrogen having a chosen mole fraction of oxygen, comprising:

expanding a pressurized stream of a precursor fluid mixture comprising oxygen and nitrogen having a mole fraction of oxygen greater than said chosen mole fraction so as to form a primary two-phase mixture comprising a vapor phase depleted of oxygen and a liquid phase enriched in oxygen;

disengaging the vapor phase from the liquid phase;

condensing a stream of vapor phase; and passing the condensate to storage as said product cryogenic liquid mixture.

2. The method according to claim 1, in which the stream of precursor cryogenic fluid mixture is formed by separating water vapor and carbon dioxide from, and cooling a flow of compressed air.

3. The method according to claim 1, in which the mixture is formed by separating water vapor and carbon dioxide from, and cooling, a flow of compressed air, expanding the compressed air so as to form a secondary two-phase mixture comprising a vapor phase depleted of oxygen and a liquid phase enriched in oxygen, disengaging the vapor phase of the secondary two-phase mixture from the liquid phase of the secondary two-phase mixture, and condensing the vapor phase of the secondary two-phase mixture.

4. The method according to claim 3, in which the vapor phase of the secondary two-phase mixture is condensed in indirect heat exchange with a stream of a liquid phase of the secondary two-phase mixture, the stream of the liquid phase of the secondary two-phase mixture having been expanded upstream of its heat exchange with the stream of the condensing vapor phase of the secondary two-phase mixture.

5. The method according to claim 2, in which the flow of compressed air is cooled in heat exchange with one or more streams of working fluid which has been expanded with the performance of external work.

6. The method according to claim 2, in which the flow of compressed air is cooled in heat exchange with one or more return streams from a rectification column in which air is separated.

7. The method according to claim 2, in which the flow of compressed air is cooled in heat exchange with the stream of the liquid phase disengaged from the primary two-phase mixture, the said stream of the liquid phase entering said heat exchange downstream of its heat exchange with the condensing vapor phase of the primary two-phase mixture.

8. The method according to claim 1, in which the precursor cryogenic fluid mixture begins its expansion as a supercritical fluid.

9. The method according to claim 1, in which the precursor cryogenic fluid mixture begins its expansion in liquid state.

10. The method according to claim 1, in which the stream of the vapor phase of the primary two-phase mixture is condensed in heat exchange with a stream of the liquid phase of the primary two-phase mixture, the stream of the liquid phase of the primary two-phase mixture having been expanded upstream of its heat exchange with the stream of the liquid phase of the primary two-phase mixture.

11. The method according to claim 1, in which the product cryogenic liquid mixture has a mole fraction of oxygen in the range of from between about 0.14 to about 0.20.

12. An apparatus for producing a product cryogenic liquid mixture comprising oxygen and nitrogen having a chosen mole fraction of oxygen, said apparatus comprising:

means for expanding a pressurized stream of a precursor cryogenic fluid mixture comprising oxygen and nitrogen having a mole fraction of oxygen greater than said chosen mole fraction so as to form a primary two-phase mixture comprising a vapor phase depleted of oxygen and a liquid phase enriched in oxygen;

means for disengaging vapor phase from the liquid phase;

a condenser for condensing a stream of the vapor phase; and a storage vessel for storing the condensate as said product cryogenic liquid mixture.

13. The apparatus according to claim 12, in which the expansion means comprises a valve.

14. The apparatus according to claim 12, in which the means for disengaging the vapor phase from the liquid phase comprises a phase separator.

15. The apparatus according to claim 12, additionally including an air liquefier for forming the pressurized stream of the precursor cryogenic fluid mixture, or a stream from which the pressurized stream of the precursor cryogenic fluid mixture is able to be derived.

16. The apparatus according to claim 15, in which the liquefier forms part of an air separation apparatus.

* * * * *